United States Patent [19]

Horsley et al.

[11] Patent Number: 5,054,604

[45] Date of Patent: Oct. 8, 1991

[54] CONVEYING ROD-LIKE ARTICLES

[75] Inventors: John K. Horsley; John E. Nixon, both of High Wycombe, Great Britain

[73] Assignee: Molins, PLC, London, England

[21] Appl. No.: 518,563

[22] Filed: May 3, 1990

Related U.S. Application Data

[62] Division of Ser. No. 640,883, Aug. 15, 1984, Pat. No. 4,938,340.

[30] Foreign Application Priority Data

Aug. 10, 1984 [GB] United Kingdom ..... 8420347

[51] Int. Cl.[5] ..... B65G 47/26

[52] U.S. Cl. ..... 198/444; 198/623; 198/579

[58] Field of Search ..... 198/347.3, 415, 572, 198/579, 623, 462, 577, 575, 626.5, 461, 444

[56] References Cited

U.S. PATENT DOCUMENTS

| | | | |
|---|---|---|---|
| 1,070,759 | 8/1913 | Willits | 198/623 |
| 1,097,012 | 5/1914 | Eldredge . | |
| 2,069,872 | 2/1937 | Burns | 198/415 |
| 2,709,000 | 5/1955 | Frank et al. | 198/626.5 |
| 3,380,459 | 4/1968 | Schmermund | 198/623 |
| 3,878,852 | 4/1975 | Van Hall | 198/461 |
| 3,952,854 | 4/1976 | Selonke et al. | 198/347.3 |
| 4,147,247 | 4/1979 | Clarke | 198/577 |
| 4,192,639 | 3/1980 | Jones | 198/623 |
| 4,200,181 | 4/1980 | Clarke | 198/347.3 |
| 4,273,233 | 6/1981 | Hinchcliffe et al. | 198/347.3 |
| 4,308,944 | 1/1982 | Probst | 198/462 |
| 4,368,242 | 1/1983 | Wahle et al. | 198/347.2 |
| 4,938,340 | 7/1990 | Horsley et al. | 198/462 |

FOREIGN PATENT DOCUMENTS

| | | | |
|---|---|---|---|
| 1159794 | 7/1969 | United Kingdom | 198/572 |
| 1309741 | 3/1973 | United Kingdom . | |
| 1573411 | 8/1980 | United Kingdom . | |
| 2144696 | 3/1985 | United Kingdom | 198/462 |

*Primary Examiner*—Joseph E. Valenza

*Attorney, Agent, or Firm*—Antonelli, Terry, Stout & Kraus

[57] ABSTRACT

Rod-like articles, particularly cigarettes or cigarette filter rods, are conveyed in a stream in a direction transverse to their lengths at a speed which is progressively reduced, so that the height of the conveyed stream is increased. Prior to the reduction in conveyance speed the speed of individual articles is increased briefly to avoid damage from following articles. The speed reduction takes place in a path having divergent boundary walls.

10 Claims, 1 Drawing Sheet

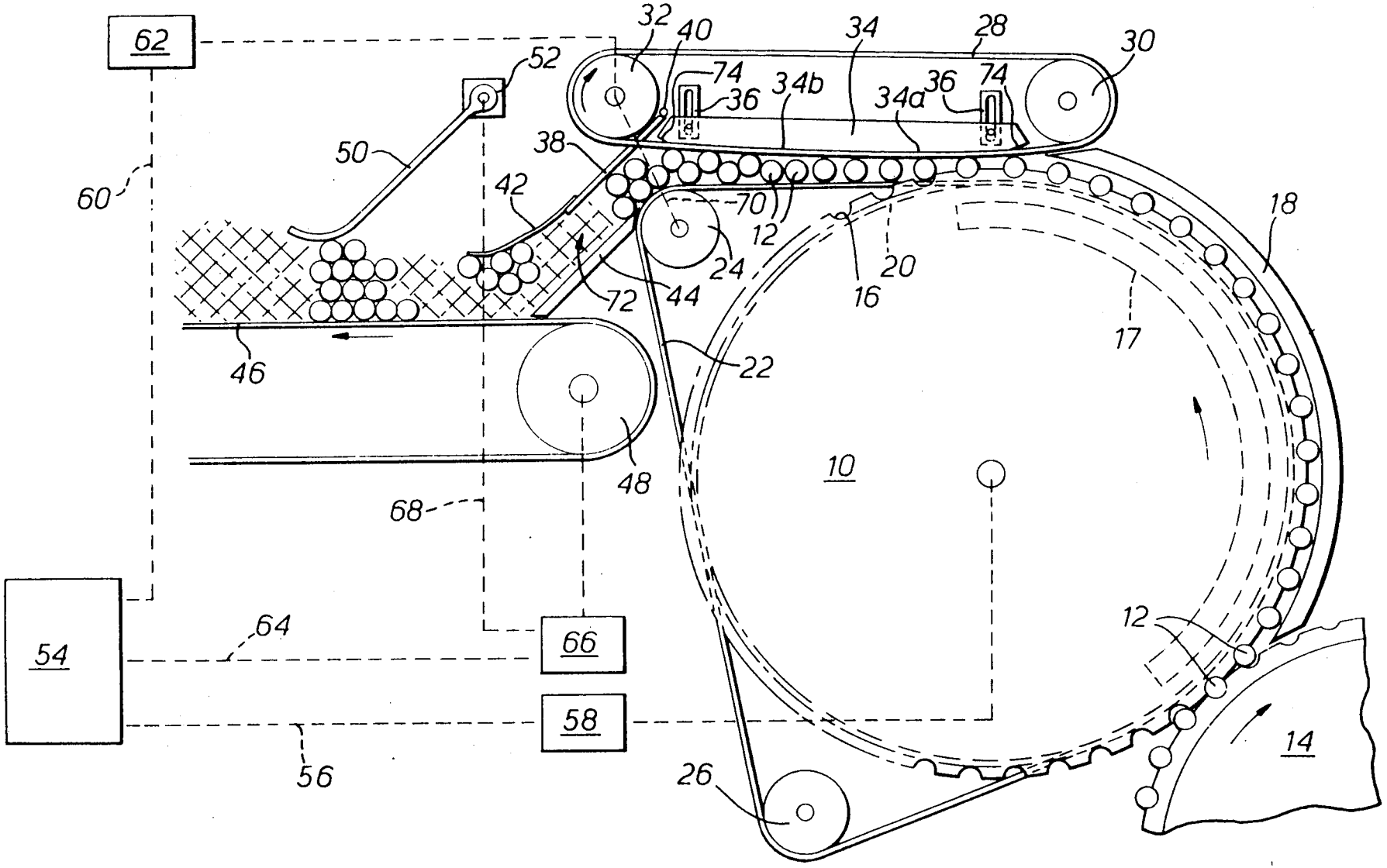
10
12
14
16
17
18
20
22
24
26
28
30
32
34
34a
34b
36
38
40
42
44
46
48
50
52
54
56
58
60
62
64
66
68
70
72
74

CONVEYING ROD-LIKE ARTICLES

This application is a divisional of application Ser No. 640,883, filed Aug. 15, 1984, now U.S. Pat. No. 4,938,340.

This invention relates to conveying rod-like articles, particularly cigarettes or other rod-like articles of the tobacco industry.

In the tobacco industry it is common to convey rod-like articles such as cigarettes or cigarette filter rods between machines or parts of a machine in a direction transverse to their lengths. It has become increasingly common to convey articles in this manner in multiple-layer stacks, typically from about 4 to 15 articles in depth. Stack forming appartus in which a single-layer stream of transversely-moving articles is formed into a multiple-layer stream is already known, for example from British Patent Specifications Nos. 1453191 (ref. 2016) and 2081664 (ref. 3344). Normally a stack of articles is formed from a single-layer stream of articles by reducing the conveying speed of the articles.

One aspect of the invention provides apparatus for conveying rod-like articles in a direction transverse to their lengths, comprising first conveyor means for conveying a first stream of articles, second conveyor means arranged downstream of the first conveyor means for receiving articles from the first stream and for conveying them in a second stream, further conveyor means for engaging rod-like articles at a position downstream of at least part of said first conveyor means and upstream of at least part of said second conveyor means, means for driving said first conveyor means at a first speed, means for driving said second conveyor means at a second speed which is lower than said first speed, and means for driving said further conveyor means at a speed which is higher than said first speed.

In a preferred arrangement the first stream comprises a single layer stream of spaced articles and the second stream comprises a multi-layer stream of articles in stack formation. The first and second conveyor means are preferably connected by a path for articles arranged so that the articles are generally progressively decelerated downstream of said position at which said further conveyor means engages said articles. Progressive deceleration of the articles is believed to cause less degradation and damage to the articles than a sudden deceleration. The articles are accelerated, however, by the further conveyor means, preferably at a position immediately downstream of at least a part of the first conveyor means which has a major influence on the speed of conveyance of the articles, to prevent excessive impact from articles conveyed by the first conveyor means and/or by the first conveyor means itself. Such impact has been found to be particularly damaging to delicate rod-like articles such as cigarettes.

The invention is particularly usefully applied in an arrangement where a third conveyor means is arranged for conveyance of articles between the first conveyor means and the second conveyor means, and in which the third conveyor means conveniently has a speed which is slightly lower than the speed of the first conveyor means. Thus, in this arrangement the first conveyor means may comprise a fluted drum, the second conveyor means may comprise an endless band stack conveyor, and the third conveyor means may comprise one or more endless bands passing around the periphery of the fluted drum in one or more circumferential grooves of such depth that the outer surface of the band or bands is at a similar level to the bases of the flutes of the drum. The band or bands of the third conveyor means may extend from the fluted drum towards the second conveyor means and partly define a path for articles conveyed between said first and second conveyor means. The path may be defined in addition by said further conveyor means, which preferably comprises further band conveyor means spaced from said fluted drum and said third conveyor means. The further and the third conveyor means may be spaced apart in an upstream portion by a distance which is slightly less than the diameter of an article to be received from the fluted drum, and may be arranged to diverge in a downstream portion. Since the speed of conveyance of the further conveyor means is higher than that of the third conveyor means successive articles received from the fluted drum are accelerated, preferably by rolling, in said upstream portion.

In general path defining means may extend between the first conveyor means and the second conveyor means, and may define a divergent path portion. Such a path portion provides for progressive deceleration of the articles between the relatively high speed of the first (and further) conveyor means and the relatively low speed of the second conveyor means. The path defining means may include guide means for one or more band conveyors (which may comprise said further and/or said third conveyor means). The guide means may comprise one or more pulleys and/or one or more support surfaces for operative runs of band conveyors. The guide means may be adjustable for height and/or angle of divergence (and inclination).

The means for driving the first and/or the second and/or the further conveyor means may include means for varying the speed of the respective means, and may for example include a variable speed transmission.

An article flow controlling or impeding device, which is preferably movable, may be provided in a downstream portion of a path for articles extending between the first conveyor means and the second conveyor means. Thus, such a device, which may be in the form of a resiliently-loaded relatively flexible flap or strip, may extend into or across the path but be displaceable by pressure of articles advanced towards the second conveyor means. The back-pressure thereby created ensures that the path remains relatively full of articles. This is particularly important where a diverging path is provided for the articles to facilitate progressive deceleration of the articles.

According to another aspect of the invention a method of conveying rod-like articles in a direction transverse to their lengths comprises conveying articles in a single layer stream at a first speed, and receiving articles from said stream and conveying them in a multi-layer stream at a second speed which is lower than said first speed, in which articles from said single-layer stream are accelerated and conveyed at a speed which is higher than said first speed before being received in said multi-layer stream.

According to another aspect of the invention apparatus for conveying rod-like articles in a direction transverse to their lengths includes first conveyor means for conveying a first stream of articles, second conveyor means arranged downstream of the first conveyor means for receiving articles from the first stream and for conveying them in a second stream, said second stream being of greater height than said first stream, and means defining a path for articles between said first conveyor means and said second conveyor means, said path including a divergent portion. The mean distance between articles may progressively reduce in said divergent portion.

Preferably the path defining means includes at least one endless band conveyor. Means may be provided for driving said conveyor at a higher speed than the first conveyor means. The path defining means may include a first path portion having substantially parallel sides spaced by about the same distance as the diameter of an article to be conveyed and a second path portion which diverges. An article flow controlling or restricting device may be arranged in said path, to ensure that the path remains substantially full of articles.

The invention will be further described, by way of example only, with reference to the accompanying diagrammatic drawing, which shows a conveyor arrangement for filter cigarettes.

A fluted drum 10 is arranged at the downstream end of a filter cigarette assembling machine and receives filter cigarettes 12 from an upstream fluted drum 14. The flutes 16 of the drum 10 are provided with suction from a manifold 17 to retain the cigarettes 12, and an arcuate guide 18 extends around a corresponding part of the drum. The drum 10 is formed with laterally spaced peripheral grooves 20 in which run a pair of endless bands 22. Only one groove 20 and band 22 is visible in the drawing. The bands 22 pass around part of the drum 10 and also around spaced pulleys 24, 26. The base diameter of the grooves 20 and the thickness of the bands 22 are such that the outer surface of the bands on the drum 10 are level with the bases of the flutes 16. The spacing of the bands, 22 in relation to the axial position of the cigarettes 12 on the drum 10 is such that the bands 22 are equidistant from the ends of the cigarettes.

The run of the bands 22 between the upper part of the drum 10 and the pulley 24 extends generally horizontally. A further pair of laterally spaced endless bands 28 extends above this run and passes around spaced pulleys 30, 32. The pulley 32 is set at a slightly higher level than the pulley 30. A backing plate 34 extends between the pulleys 30 and 32 and defines the path of the lower run of the bands 28. The plate 34 includes a first surface **34*a* and a second surface 34*b* which is slightly inclined to the first surface. The plate 34 is mounted by means of adjustable slot and pin arrangements 36**, so that its height and inclination can be varied.

A strip 38 of semi-flexible plastics material, such as MELINEX, extends downwardly from between the bands 28 adjacent the pulley 32. The strip 38 may be fixed or pivoted at a position 40 and may be slightly resiliently urged towards the pulley 24. Attached to the free end of the strip 38 is a further strip 42 of rather more flexible material, such as chainmail or TISS-metal.

An inclined deadplate 44 is located below the pulley 32 and adjacent the pulley 24. Immediately below the lower end of the deadplate 44 is the upper run of a horizontal band conveyor 46, which passes around a pulley 48. A pivoted sensor arm 50 connected to a rotary regulator 52 is arranged above the conveyor 46 adjacent the pulley 32.

A prime mover 54, which may be a main motor for the filter assembling machine, is connected for drive of the drum 10 by a transmission 56 which includes a drive ratio device(e.g. a gearbox) 58. Similarly, the pulley 32 is connected to the prime mover 54 by a transmission 60 including a drive ratio device 62, and the pulley 48 is connected to the prime mover by a transmission 64 including a drive ratio device 66. Each of the devices 58, 62, 66 may be fixed or variable ratio devices. The device 66 includes provision for control in response to signals obtained on a line 68 from the sensor regulator 52. For example, the device 66 may incorporate a clutch or means for proportionally changing the ratio of the transmission 64.

The transmissions 56, 60, 64 may comprise any conventional drive means, e.g. gears, sprockets and chains, and/or timing belts and suitable pulleys. It should be noted that a simple timing belt passing around pulleys having suitable teeth engaging the belt constitutes a transmission including a fixed ratio device.

As an alternative to the transmission 60, particularly where a fixed ratio transmission is required, the drive for the pulley 32 may be taken from the drum 10 or, more conveniently, from the pulley 24, as indicated by the alternative transmission 70.

The bands 22, 28, 46, may be plain on both surfaces or may incorporate drive teeth for engagement with a respective pulley or drum. In a preferred arrangement the bands 22 and 28 are plain and the band 46 includes drive teeth. In addition, the band 46 could include protrusions on its upper surface to provide increased traction and more positive conveyance of the cigarettes.

In operation, cigarettes are received on the drum 10 from the drum 14 and conveyed in the flutes 16 around the part of the drum surrounded by the guide 18, being retained in the flutes by suction supplied from the manifold 17. At the upper part of the drum 10 the spacing between the bands 22 running in the grooves 20 and the lower run of the bands 28 beneath the surface **34*a* of the backing plate 34 is very slightly less than the diameter of a cigarette 12, so that each cigarette is gripped between the bands 22 and 28. The parts of the bands 28 backed by the surface 34*a* are substantially parallel to the runs of the bands 22 extending from the drum 10 to the pulley 24. The speed of the bands 22 is very slightly less than that of the cigarettes 12 being conveyed in the flutes 16: this is because the bands 22 are conveyed by the drum 10 at a radial distance which is less than that at which the centers of the cigarettes 12 are conveyed. The speed of the bands 28, as set by the transmission 60, is greater than that of the bands 22, preferably by 10–15%. Consequently, some rolling and acceleration of cigarettes 12 occurs subsequent to initial engagement between the bands 22 and 28. This ensures that cigarettes 12 leaving the flutes 16 are not subject to impact or pressure from the upper rear surfaces of the flutes 16 or from following cigarettes 12, both of which are moving faster than the bands 22**.

Downstream of the surface **34*a* the bands 22 and 28 diverge slightly, as the bands 28 follow the slightly inclined surface 34*b*. As a consequence of this divergence the drive imparted to the cigarettes 12 is reduced, particularly that from the bands 28, so that the speed of conveyance of the cigarettes 12 is correspondingly reduced at least to that of the bands 22. It will be appreciated that increase or decrease of speed of the cigarettes 12** brings about a corresponding increase or decrease in the spacing of the cigarettes.

The strips 38 and 42 constitute an obstruction in the path of the cigarettes 12 and serve to reduce their speed in a direction generally parallel to the bands 22 and 28. In addition, the cigarettes on the conveyor 46 are in multi-layer stack formation and consequently travel much more slowly than the cigarettes on the drum 10.

A typical speed ratio would be 12:1 with a multi-layer stack of average height of four cigarettes. As a result of the obstruction caused by the strips 38 and 42 and the slower conveyance speed on the conveyor 46 a region 72 just beyond the ends of the bands 22, 28 and above the conveyor 46 contains cigarettes which are moving more slowly than those between the upstream paths of the bands 22, 28. In use, therefore, cigarettes in this stack forming region 72 present a major obstruction to cigarettes issuing from the bands 22, 28. Cigarettes 12 are therefore retarded in the divergent region between the bands 28 passing over the surface 34*b* and the bands 22. As shown in the drawing, the mean spacing between cigarettes 12 is progressively reduced from the start of the surface 34*b* to the downstream end of the bands 22, 28 (and also through the region 72 onto the conveyor 46). The progressive divergence of the bands 22, 28 results in progressive deceleration of the cigarettes upstream of the stack forming region 72. The strips 38 and 42 help to continue the progressive deceleration through the stack forming region 72. Progressive speed reduction reduces impact, and therefore degradation, of the cigarettes 12.

The position of the plate 34 is determined by the mounting arrangements 36. The plate 34 is preferably positioned so that it projects beyond a straight line passing between the lower surfaces of pulleys 30, 32. It will be noted that the plates 34 have tapered surfaces 74 at each end to allow this. The inclination of the plate 34 is preferably set so that the surface 34*a* is parallel to the bands 22, but this surface could diverge slightly from the bands 22 in a similar way to the surface 34*b*. The plate 34 could be replaced by one or more other plates (the inclinations and heights of which may be separately adjustable), or by a plate having differently inclined surfaces or a flat surface.

The position of the pulley 30 and/or the pulley 32 could be adjustable. The upper bands 28 could be horizontal (or inclined on a relatively straight path) and the bands 22 could be made to diverge, possibly by use of a suitable adjustable guide plate located between the drum 10 and the pulley 24. Adjustment for the position and inclination of both bands 22 and 28 could be provided.

The speed of the conveyor 46 is set by the transmission 64 according to the speed of the drum 10 to produce a stack of the required average height. Thus the ratii of the devices 58 and 66 may be set to values which produce a 12:1 speed ratio between the peripheral speeds of the drum 10 and the linear speed of the conveyor 46. Minor corrections of the speed of the conveyor 46, to achieve a more uniform stack height, are made by adjustment of the variable ratio device 66 by signals from the sensor 50 on the line 68.

One or both of the pairs of bands 22 and 28 could be replaced by single relatively wide bands arranged centrally relative to the cigarettes 12. Similarly, the band of conveyor 46 could be replaced by laterally spaced bands.

In the arrangement shown in the drawing, the bands 22 are driven by contact or engagement with the drum 10. Clearly, drive could be derived additionally or alternatively from one or both of the pulleys 24, 26. In a further alternative arrangement the bands 22 pass around rings which are substantially coaxial with the drum 10 so that the speed of the bands 22 may be controlled separately from that of the drum 10. The rings could themselves be driven but are preferably freely rotatable relative to the drum 10. In this way the bands 22 may be driven at a speed which is equal to or greater than the linear speed of the centres of the cigarettes 12 on the drum 10. The bands 28 may be driven at the same speed as the bands 22. Alternatively, the bands 28 could be driven faster than the bands 22, in which case operation of this alternative arrangement would be similar-to that of the arrangement shown in the drawings, or slower than the bands 22, provided that the resultant speed of the cigarettes conveyed between the bands 22 and 28 would be sufficient to avoid problems caused by impact of following cigarettes and/or the rear face of a flute 16 of the drum 10.

We claim:

1. Apparatus for conveying rod-like articles in a direction transverse to their lengths, including first conveyor means having spaced article carriers for conveying a first stream of articles, second conveyors means arranged downstream of the first conveyor means for receiving articles from the first stream and for conveying them in a second stream, said second stream being of greater height than said first stream, and means including at least one substantially horizontally disposed driven endless band conveyor extending from the region of said first conveyor means so as to receive articles substantially directly from said articles carriers and defining a substantially horizontal path along which articles are conveyed between said first conveyor means and said second conveyor means for progressively decelerating the articles as they are conveyed along at least a part of said path, said path including a progressively divergent channel portion extending along a major part of the length of said path, which channel portion progressively diverges over a distance corresponding to plural article diameters and is formed at least in part by said one driven endless band conveyor.

2. Apparatus as claimed in claim 1, wherein said path defining means includes means for causing the means distance between articles to be progressively reduced in said divergent channel portion.

3. Apparatus as claimed in claim 2, wherein the path defining means includes at least two endless band conveyors.

4. Apparatus as claimed in claim 3, wherein the path defining means includes a first path portion having substantially parallel sides spaced by about the same distance as the diameter of an article to be conveyed and a second path portion following said first path portion and forming said progressively divergent channel portion.

5. Apparatus for conveying rod-like articles in a direction transverse to their lengths, including first conveyor means having spaced article carriers for conveying a first stream of articles, second conveyor means arranged downstream of the first conveyor means for receiving articles from the first stream and for conveying them in a second stream, said second stream being of greater height than said first stream, and means including at least one driven endless band conveyor extending from the region of said first conveyor means so as to receive articles substantially directly from said article carriers and defining a path along which articles are conveyed between said first conveyor means and said second conveyor means for progressively decelerating the articles as they are conveyed along at least a part of said path, said path including a progressively divergent channel portion which extends along a major part of the length of said path and progressively diverges over a distance corresponding to plural article diameters and is formed at least in part by said one driven endless band conveyor, further including a moveable article flow controlling device arranged in said path for facilitating progressive deceleration of the articles in said progressively divergent channel portion by maintaining the path substantially full of articles.

6. Apparatus as claimed in claim 5, wherein said flow controlling device comprises a resilient obstruction disposed in said path to reduce the speed of the articles in the vicinity of the outlet of said divergent channel portion.

7. Apparatus as claimed in claim 5, wherein said flow controlling device comprises a strip of semi-flexible material disposed in said path to reduce the speed of the articles.

8. Apparatus as claimed in claim 7, wherein said strip is pivotably mounted so as to extend across said path in the vicinity of the outlet of said divergent channel portion.

9. Apparatus according to claim 1, wherein said path defining means includes guide means for supporting at least one band conveyor forming part of said divergent channel portion so as to determine the spacing between the sides of said path in at least a part of the diverging channel portion.

10. Apparatus as claimed in claim 9, including means for adjustably mounting said guide means.

* * * * *